United States Patent [19]

Gravel

[11] 4,077,803

[45] Mar. 7, 1978

[54] LOW CHARGE-VOLTAGE FROST RECORDING ON A PHOTOSENSITIVE THERMOPLASTIC MEDIUM

[75] Inventor: Robert L. Gravel, Stow, Mass.

[73] Assignee: Sperry Rand Corporation, New York, N.Y.

[21] Appl. No.: 636,779

[22] Filed: Dec. 1, 1975

[51] Int. Cl.[2] ..... G03G 16/00

[52] U.S. Cl. ..... 96/1.1; 96/1.3; 264/22; 355/9

[58] Field of Search ..... 264/22; 96/1.1, 1.3; 425/174; 355/9

[56] References Cited

U.S. PATENT DOCUMENTS

| | | | |
|---|---|---|---|
| 3,196,011 | 7/1965 | Gunther et al. | 96/1.1 |
| 3,258,336 | 6/1966 | Ewing | 96/1.1 |
| 3,317,316 | 5/1967 | Bean et al. | 355/9 |
| 3,333,958 | 8/1967 | Giaimo, Jr. | 96/1.1 |
| 3,338,710 | 8/1967 | Goffe | 96/1.1 |
| 3,436,216 | 4/1969 | Urbach | 355/9 |
| 3,441,410 | 4/1969 | Brynko | 96/1.1 |
| 3,445,226 | 5/1969 | Gundlach et al. | 96/1.1 |
| 3,547,628 | 12/1970 | Wolff | 96/1.1 |
| 3,672,883 | 6/1972 | Ciccarelli et al. | 96/1.1 |
| 3,719,483 | 3/1973 | Bean | 96/1.1 |

OTHER PUBLICATIONS

Encyclopedia of Chemical Technology, Kirk-Otmer, vol. 15, 6-1969-"Phthalocyanine Compounds," p. 489.

*Primary Examiner*—Jeffery R. Thurlow
*Attorney, Agent, or Firm*—Howard P. Terry

[57] ABSTRACT

A method and apparatus are provided for achieving substantially uniform charging of a single layer thermoplastic recording surface in either a positive or negative sense to a potential just below the frost threshold level, for exposing the thermoplastic surface to light in image configuration, and for applying a heat pulse to the thermoplastic surface for a time relatively short compared to the duration of the light exposure interval and during that exposure. The charging event is arranged so that the thermoplastic surface is raised only to a relatively low potential with respect to ground. More specifically, the consequent surface charge density on the thermoplastic surface is of a low enough magnitude that no frost is produced when the medium is cycled without exposure to light; furthermore, the quality of the recording is relatively insensitive to layer thickness.

1 Claim, 6 Drawing Figures

LOW CHARGE-VOLTAGE FROST RECORDING ON A PHOTOSENSITIVE THERMOPLASTIC MEDIUM

BACKGROUND OF THE INVENTION

1. Field of the Invention

The invention relates to the xerographic recording and data storage arts and more particularly concerns generation of frost image patterns on a surface of a thermoplastic medium charged to a potential level below the normal frost formation potential.

2. Description of the Prior Art

In one commonly practiced form of electrostatic recording, an electrostatic charge pattern forms a latent image of the data or the object whose image is to be recorded on the surface of an insulating medium and is then made visible. The charge pattern may be generated by direct electrical charge deposition such as by the simple process of irradiation of the insulator surface by electrons flowing through a stencil. The more usual process involves the cooperative action of an electric field and a pattern of different shades of light projected onto the surface of an insulating photoconductor layer. The latent image thus formed is then rendered visible by deposition of fine electroscopic developer particles which adhere only where the charges reside. The visible powder image, once formed, is fixed or developed permanently on the surface of the photoconductor medium, or the particles forming the powder image may be transferred intact to a record medium where they then are developed and made permanent. Only when the powder image is actually transferred is the photoconductor medium re-usable.

A more recent kind of electrostatic recording involves deformation of a thermoplastic medium whereby permanent or erasable recording may be effected according to two distinct methods now universally known as the relief and the frost methods, respectively. While both of these methods generate image patterns by deformation of a thermoplastic material in response to electrostatic forces located in a latent charge surface image, the relief imaging method enjoys only specialized use. Image formation by the relief method depends upon the presence of significant electrostatic gradients; thus, a single line deformation may be generated along a locus defined by a steep charge gradient and relief imaging therefore does not occur where there is a uniform of slowly changing charge distribution.

On the other hand, the frost type of thermoplastic recording in its simplest form provides on uniformly charged areas a uniform distribution of relatively very small random surface wrinkles that scatter light and are best described as having a frosted appearance. Frost images are readily projected or read out in contrast to relief images, which are characterized as inherently storing phase data and require complex read-out optics of the Schlieren type. The present invention is therefore directed to an improvement in relatively less complex prior art frost thermoplastic recording methods.

In the usual frost method of imaging on thermoplastic material, a latent-image-defining electrostatic charge pattern is formed on a heat-softenable insulating film depending upon the use of a suitable photoconductive layer lying under the deformable film. Typical processing steps applied to this photoreceptor configuration involve a charging step, an optical exposure step for proportionally discharging the illuminated areas on an image basis, and a development step wherein the surface of the thermoplastic layer is heated and thus allowed to deform by interaction of surface tension forces and the remaining charge forces. Advantageously, the frost images formed may be viewed directly with simple optical techniques because of the light-scattering character of the deformed surface. They may therefore also readily be displayed by simple optical projection techniques as by transmission of light through the deformed surface, or as in microfilm readers, by reflection of light therefrom. The frost process not only reproduces line images as readily as the relief process but, additionally, the frost images beneficially exhibit solid area coverage and continuous or smoothly graded tone response. Therefore, the frost imaging process has highly desirable versatility, being suited to recording or for storage of data, as well as for performing any of the copying and photographic functions normally associated with xerographic processes, and additionally not requiring the application of liquid or powder toner or developer materials vital to many types of conventional xerography methods. The recorded images generated by the simpler of conventional frost processes are normally "negative" replicas of the original object, i.e., the frost appears at the areas of the latent image not discharged by object light, so that bright areas of the actual object appear dark in the developed image when viewed or read out by simple and inexpensive methods, and vice versa.

More specifically, one common prior art frost recording method uses three primary steps, the first providing uniform charging of a thermoplastic insulating layer surface by actuation of a conventional corona discharge device or corotron. This is followed by exposure of a photoconductor layer associated with the thermoplastic layer with the optical image to be recorded and then by final fixing or development of the image on the insulator surface by substrate or surface heating and then cooling. In such a conventional process, the surface potential of the insulating layer must be high, being generally of the order of 200 to 500 volts with respect to ground, a potential level which is achieved only by applying a unidirectional potential of 8 to 10 kilovolts with respect to ground to the corotron charging electrode for an insulating thermoplastic layer of commercially acceptable thickness. Even higher voltages are required for thicker layers, since the threshold voltage at which frosting obtains is generally proportional to the square root of the thickness of the insulator layer thickness. After charging, the configuration is exposed to a white light image, heavily discharging the most highly illuminated areas. The image is then developed by application of sufficient heat energy to bring the thermoplastic surface at the latent image rapidly almost to its melting point. Upon cooling, the frost image forms as a "negative" replica of the original object image, as previously mentioned. By the use of complex additional elements to the reproducing apparatus for performing additional or modified steps, such as by off-axis (oblique) illumination, it is possible to reproduce the more desirable "positive" image, i.e., a recorded image in which the frost appears at those areas of the latent charge image actually discharged by light, so that bright areas of the object actually appear light in the developed image when viewed or read out by simple and inexpensive methods, and vice versa.

High voltages such as those conventionally used in the charging mode of operation of conventional thermoplastic recording apparatus are well known to be dangerous to the operator; other disadvantages accrue to their use, such as the increased tendency of the circuits involved and the parts of the corotron to be unreliable and to be short lived, even failing catastrophically after only short service. Such failures may represent a fire hazard, or may otherwise cause damage to the recording medium itself which is particularly disadvantageous in data storage systems where the mechanism is in a form suitable for recycling of the thermoplastic surface after erasure of stored data. Aging of the thermoplastic medium is well known to be undesirably accelerated by many cycles of high voltage charging and demonstrates itself by a gradual increase in melting temperature. The material additionally tends to stiffen so that the desired frost deformation is increasingly difficult to form. The aging mechanism may not be fully understood, but may in fact be connected with structural changes producing molecules of greater molecular weight. Also, spectrographic tests indicate that oxidation of the thermoplastic layer may occur. Accordingly, it is seen that conventional frost thermoplastic reproduction or storage techniques, while filling a long felt need in the industry, generally have certain disadvantages, a primary disadvantage being concerned with the requirement for the use of a relatively high charging potential.

SUMMARY OF THE INVENTION

According to the present invention, novel methods and apparatus are provided whereby improved thermoplastic recording or storage is performed through the generation of frost patterns on a surface of a transparent single layer photosensitive thermoplastic medium. The objects of the invention are to overcome the aforementioned difficulties inherent in prior art frost pattern recording apparatus and methods, particularly by operation at significantly lower charging potentials whereby recorded data or images are produced by simple and inexpensive apparatus, images that are direct replicas of the objects or data images to be stored; i.e. the recorded image is such that bright areas of the object actually appear light in the developed image, and vice versa, with the gradations between light and dark areas substantially matching those of the object. In other words, a true "positive" image that substantially replicates the object is recorded or stored. While retaining the advantages of prior art frost reproduction systems, the invention also forms the frost image in essentially a single-layer thermoplastic medium of simple nature, the low charging voltage greatly reducing the probability of damage to and aging of the thermoplastic medium during multiple charging cycles. Recording medium fatigue is correspondingly diminished, an essential condition in optical storage systems of the kind, for example, in which the medium is erased and repeatedly reused.

In a particular embodiment of the invention, apparatus is provided at least for achieving substantially uniform charging of the thermoplastic surface in either a positive or negative sense to a potential just below the frost threshold level, for exposing the thermoplastic surface to light in image configuration, and for applying a heat pulse to the thermoplastic surface for a time relatively short compared to the duration of the light exposure interval and during that exposure. The charging event is arranged so that the thermoplastic surface is raised only to a relatively low potential with respect to ground. More specifically, the consequent surface charge density on the thermoplastic surface is of a low enough magnitude that no frost is produced when the medium is cycled without exposure to light. This is in contrast to the prior art frost methods, wherein the surface charge is normally above the frost threshold, so that frost is normally produced where the medium is not light-struck. The complications of optical screening or grating devices sometimes used in thermoplastic xerography are also rendered unnecessary.

DESCRIPTION OF THE PREFERRED EMBODIMENTS

Figure 1:
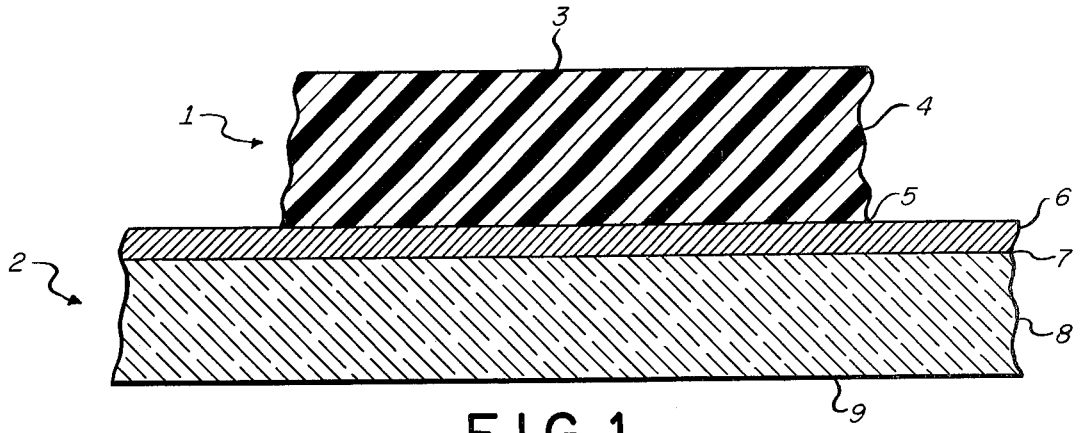
FIG. 1 is a cross section view of the thermoplastic record medium employed in the present invention.

Referring to FIG. 1, there is shown in a drawing that is not necessarily drawn to a practical scale, since it is intended to illustrate the invention clearly for discussion purposes, a photosensitive film 1 used according to the invention as a recording medium disposed on a supporting substrate element 2 which, as will be seen, has several functions to perform with respect to film 1. It will be understood that the supporting substrate element 2 may be a plate fixed in position when in use, or that the substrate 2 and the photosensitive film 1 may be moved together by conventional transport means into an operating station or stations and then out of such stations. Such conventional operations may be facilitated by use of a supporting substrate 2 and photosensor film 1 in the form of an endless flexible felt, as is conventional practice in certain optical storage systems in which, for example, a final erasure station may be employed.

The photosensitive system 1, 2 in one form uses a rigid plate substrate element 2. While various arrangements of materials known to those skilled in the art may be selectively employed, the substrate element 2 in one form of the invention consists of a plate 8 of ordinary transparent glass having a coating at the interface 7 of an electrically conductive layer 6 so thin as to be optically transparent. The plate 8 in one successful arrangement consists of a thin glass plate with a transparent layer 6 of tin oxide, a combination of a type commercially available from the Corning Glass Works of Corning, New York. Indium oxide on a glass substrate may be used in a combination available from the PPG Industries, Harman Township, Pennsylvania.

Where a mechanically flexible record medium is desired, the substrate element 2 may include an optically-transparent flexible material such as a web 8 of a transparent commercially available polyester material having bonded thereto at interface 7 a thin coating 6 of an electrically conducting material. For example, a thin coating of sputtered or evaporated aluminum or other electrically conducting metal will retain the desired optically transparent characteristics of the combination. Materials such as polyethylene terephthalate are found useful in forming the flexible substrate layer 8, as are other web materials sold under the trade name "MYLAR" by E. I. du Pont de Nemours and Company.

The photosensitive film 1 for providing the surface 3 for the formation of frost patterns may be bonded at interface 5 to the electrically conductive layer 6 in any case by conventional methods, such as by spraying, dipping, or otherwise coating the substrate support with a layer 4 of a selected photosensitive material. While various materials may be selected for the purpose, a preferred form of the invention employs a commercial grade of a polystyrene thermoplastic resin for layer 4. Relatively low molecular weight thermoplastic materials such as styrene resins are desirable and they must be optically transparent. Non-polar materials are suitable which have a resistivity high enough that the electrical charge pattern retains its character and distribution at the surface softening temperature, including materials that melt at about 70° Centigrade, for example, as measured by the conventional ball-and-ring test method. One such material is commercially available from the Pennsylvania Industrial Chemical Corporation of Clairton, Pennsylvania under the trade name "Piccolastic A-75".

Such thermoplastic materials are characterized by estimated molecular weights, for example, of the order of 400, and are readily soluble, being relatively compatible with other organic chemicals. The solid material is hard and tough and is resistant to mechanical shock and to moisture. The "Piccolastic A-75" material alone has a 75° Centigrade ball-and-ring softening point and at the softening point, an electrical resistivity of $10^{12}$ to $10^{18}$ ohm-centimeters, a dielectric constant of 2.5, and a surface tension of 36 about dynes. In use, the material gives consistently good quality images, high speed of response, and long life. A product of Hercules, Inc. of Wilmington, Delaware sold under the trade name "Staybelite Ester 10" and which is a glycerol ester of hydrogenated resin is similarly found useful in forming the thermoplastic resin layer 4.

The thermoplastic resin layer 4 provides the surface 3 at which frost patterns are to reside, and additionally acts as a binder supporting a multiplicity of fine particles of a photosensitizing material. For this purpose, a dispersion of a form of a photoconductor such as a phthalocyanine dye may be used as the photoreceptor. Such materials are known to have sensitivity to white light equal to that of selenium and may be used in recycled reproducing operation many times. The phthalocyanines are a known group of organic colorants having as a structural unit four isoindole groups linked by four nitrogen atoms. Though sometimes used in the metal-free form, it is preferred to use copper phthalocyanine in the present invention. The latter sensitizer under the trade name "Microlith Blue 4GT" is available from the Ciba-Geigy Corporation, Ardsley, New York.

To form the coating material of layer 4, a method such as the following may be used. When approximately 8 percent by weight of the sensitizer material is added to the thermoplastic and dissolved by thorough stirring in trichloroethylene, a photosensitive film 1 may be obtained by pulling the substrate 2 from the mixture in a conventional manner at a rate of approximately 10 centimeters per minute. No additional organic or other additives are used. Thickness of the photosensitive film 1 may be adjusted from 3 to 8 microns in a conventional manner, such as by varying the amount of the solvent trichloroethylene from 40 to 30 milliliters, respectively, when the liquid contains substantially 1.6 grams of the dispersed sensitizer in substantially 20 grams of the dissolved thermoplastic resin. Layers varying in thickness from 1.2 to 7 microns are found useful, since the behavior of the low charge recording mechanism of the present method is relatively independent of film thickness. This is in beneficial contrast to the situation with respect to conventional frost recordings, where the frost threshold level, as previously noted, decreases as the square root of film thickness and the random frost generation period varies inversely with decreasing film thickness. As soon as the solvent material has evaporated, the recording material is ready for use. Other proportions may be selected and other known ingredients will be found useful in practicing the invention by those of ordinary skill in the art without departing from the actual scope of the invention.

Figure 2:
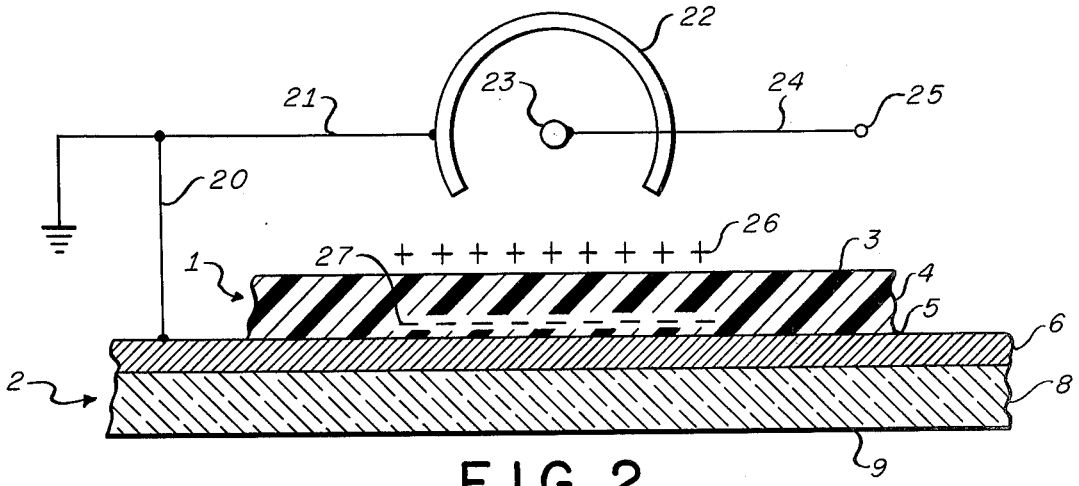
FIG. 2 is an elevation view, partly in cross section, of a charging station in operation with the record medium of FIG. 1.

FIG. 2 illustrates the novel photosensitive system 1, 2 of FIG. 1 in association with conventional apparatus for electrically charging the thermoplastic surface 3 in a generally uniform manner, the reference numerals 1 through 8 corresponding to those of FIG. 1. In charging the surface 3 of the photosensitive film 1, any of a variety of available corona discharge devices may be employed. For illustration purposes, a simple corotron involving a wire electrode 23 surrounded by a partly open cylindrical shell 22 is illustrated. As in conventional practice, electrode 23 may be supplied via lead 24 with a controlled duration charging voltage from a suitable source coupled to terminal 25. As in usual practice, the conductor layer 6 and the shell 22 are placed at ground potential by the respective leads 20 and 21. As seen in the figure, current flow from electrode 23 irradiating insulator surface 3 will charge it substantially uniformly to a particular potential level as indicated at 26, effectively inducing an opposite charge 27 in insulator layer 4 at interface 5. The particular potential level is, according to the present invention, somewhat below the frost formation threshold level; i.e., below the level at which frost would be formed as a consequence of subsequent exposure of surface 3 to light. It will be understood that the relative charge polarities illustrated in FIG. 2 are selected merely for illustrative purposes, since the invention is equally useful when the polarities of the charge patterns 26 and 27 are reversed, provided that the appropriate corotron system is employed.

Operation of the charging cycle discussed in connection with FIG. 2 and subsequent steps according to the invention may be further understood in connection with FIGS. 3 and 4. With particular respect to FIG. 4, elements corresponding to those illustrated in FIG. 2 bear the same reference numerals, including elements 1 through 9 and 20 through 27. FIG. 4 illustrates apparatus for operating the corona device 22, 23, including a conventional voltage pulse generator 35 controlled by a conventional timer 45 via lead 38 to supply the charging voltage to lead 24 of the corotron during the representative charging interval A–B of FIG. 3. Timer 45 is additionally adapted in a conventional manner to control the operation via lead 44 of a conventional voltage pulser 43. The control pulse thus generated is coupled via lead 42 to open the normally closed (opaque) optical shutter 40 associated with light sources 41. Opening of shutter 40 for a predetermined time interval permits white light in image formation to pass through substrate 8, layer 6, and the photosensitive layer 4, thereby altering the uniform charge pattern on surface 3 in direct correspondence with that image during the time interval C–F. The latent image corresponds to the image of object 47 shown positioned for projection in the opening 46 in a wall of light source 41. Alternatively, shutter 40 may be eliminated and light source 41 may be turned on and off directly by signals furnished by timer 45 and pulser 43.

Figure 3:
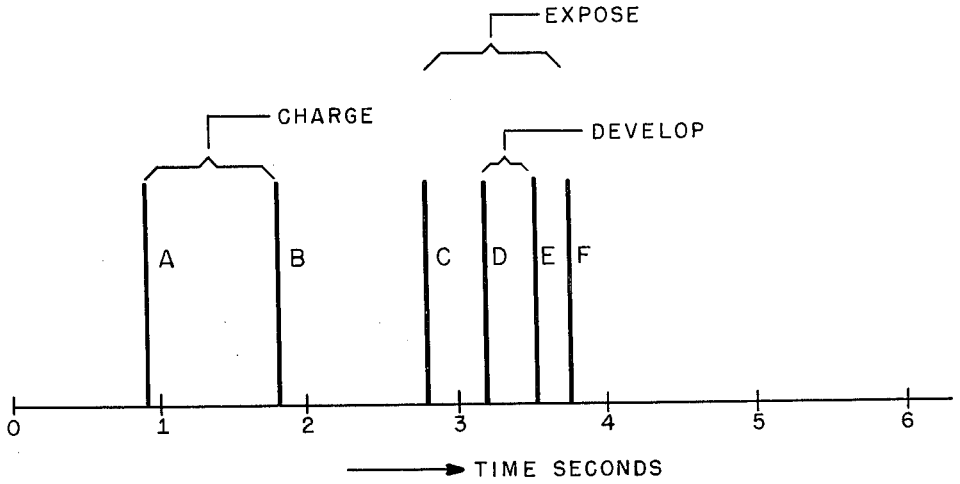
FIG. 3 is a timing graph useful in explaining the operation of the invention.
Figure 4:
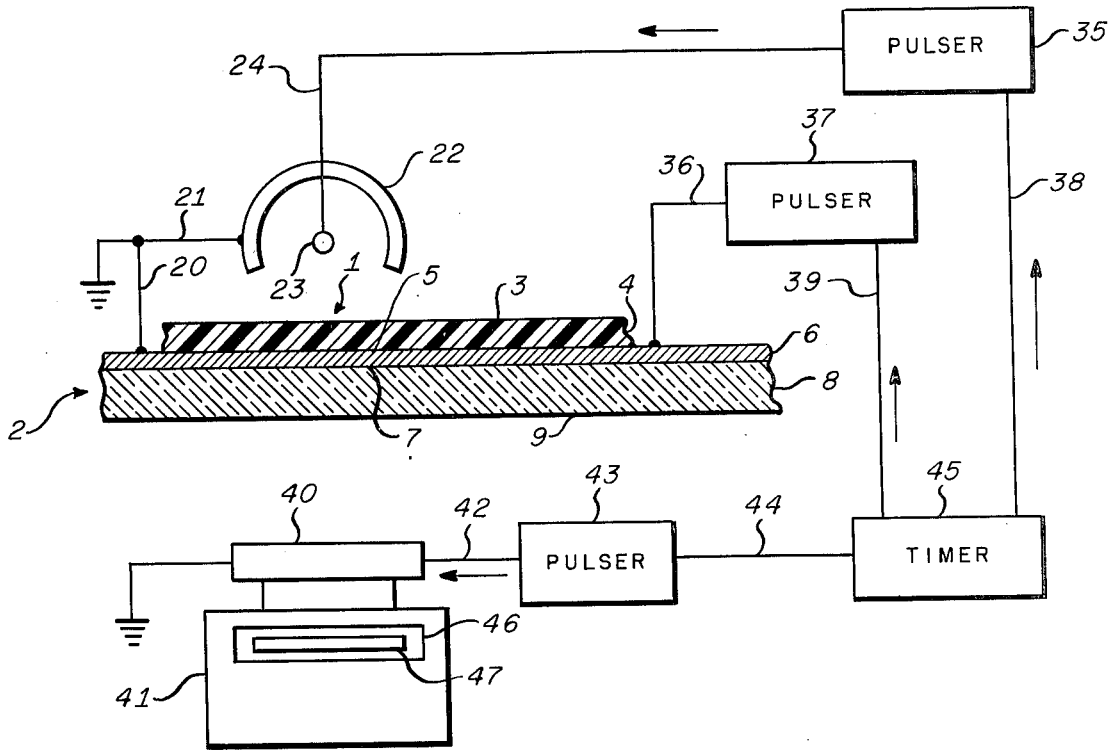
FIGS. 4 and 5 are elevation views, partly in section, of embodiments of the invention, showing associated electrical apparatus and interconnections.

An important feature of the apparatus of FIG. 4 permits development of the actual frost image on surface 3 in a time interval D–E contained within the exposure interval C–F of FIG. 3 and primarily in the latter half of the time interval C–F. This event makes a second use of the transparent metal conducting layer 6 which cooperates in the charging event and which lies between photosensitive layer 4 and the substrate element 8. One location on the conducting layer 6 may be grounded, as by lead 20, while a remote opposite location of layer 6 is supplied by a heating current pulse via lead 36 during interval D–E. The timing of the latter pulse is controlled by timer 45 via lead 39, and the heating pulse is generated by the conventional current pulser 37. At the end of the heating pulse, the image pattern is rendered permanent by deliberate or natural cooling in the conventional manner.

It will be understood that the selective excitation of pulsers 35, 37, and 43 may be controlled by a selected conventional timer 45. For instance, timer 45 may be a conventional timer micro-circuit available on the market including conventional counter and logic circuit elements for supplying controlled appropriate signals to the several pulsers. The timer 45 of FIG. 4 operates in an entirely conventional manner to open and to close switching or other elements for the formation of the desired output pulses timed according to the program illustrated in FIG. 3. It will be understood that the electronic timing system of FIG. 4 is the equivalent of and may be replaced by a motor driven slip ring-brush combination of entirely conventional nature, and that details of the structure and operation of such arrangements lie fully within the knowledge of those skilled in the art. It will further be apparent that the photosensitive system 1, 2 may be manually or automatically placed in its operating situation and removed therefrom, and that manually operated switches may be used to control pulsers 35, 37, and 43.

Fully consistent and satisfactory explanations of the physical processes involved even in conventional frost xerography methods have not been agreed upon, and it is difficult to present with full assurance an acceptable theoretical explanation of the physical factors relied upon in the present invention. Accordingly, any explanations set forth herein are offered merely as general aids in the interpretation of the invention and are not to be construed in a limiting sense. Laboratory experiments suggest that the low-charging-potential frost method of the present invention requires an energy balance between the physical properties of the thermoplastic medium (primarily the surface tension forces and the softening point of the medium), and the total applied energy associated with the surface charge, light exposure, and thermal development. Fast thermal development while the light image remains in place upon the thermoplastic surface may beneficially momentarily decrease surface tension before the surface charge pattern is discharged or at least partly dissipated. In any event, it is evident that the novel arrangement provides an advantageous mechanism whereby reliable formation of the frost image is enabled before the latent charge image is made less well defined or otherwise deformed with passage of the time usually involved in systems in which exposure is followed by a non-overlapping development time period. In addition to improve reproduction, the overlapping relation of the exposure and development steps significantly reduces the time required per cycle of operation, clearly a desirable result in itself. By the way of distinguishing the novel method from prior art frost reproduction methods, it will be apparent that the photo-induced discharge theory normally applied in describing prior art frost methods can not apply to the present invention, as the present invention uses an initial charge density below the normal frost threshold density and therefore the photoinduction discharge theory can not serve as a valid explanation.

Figure 5:
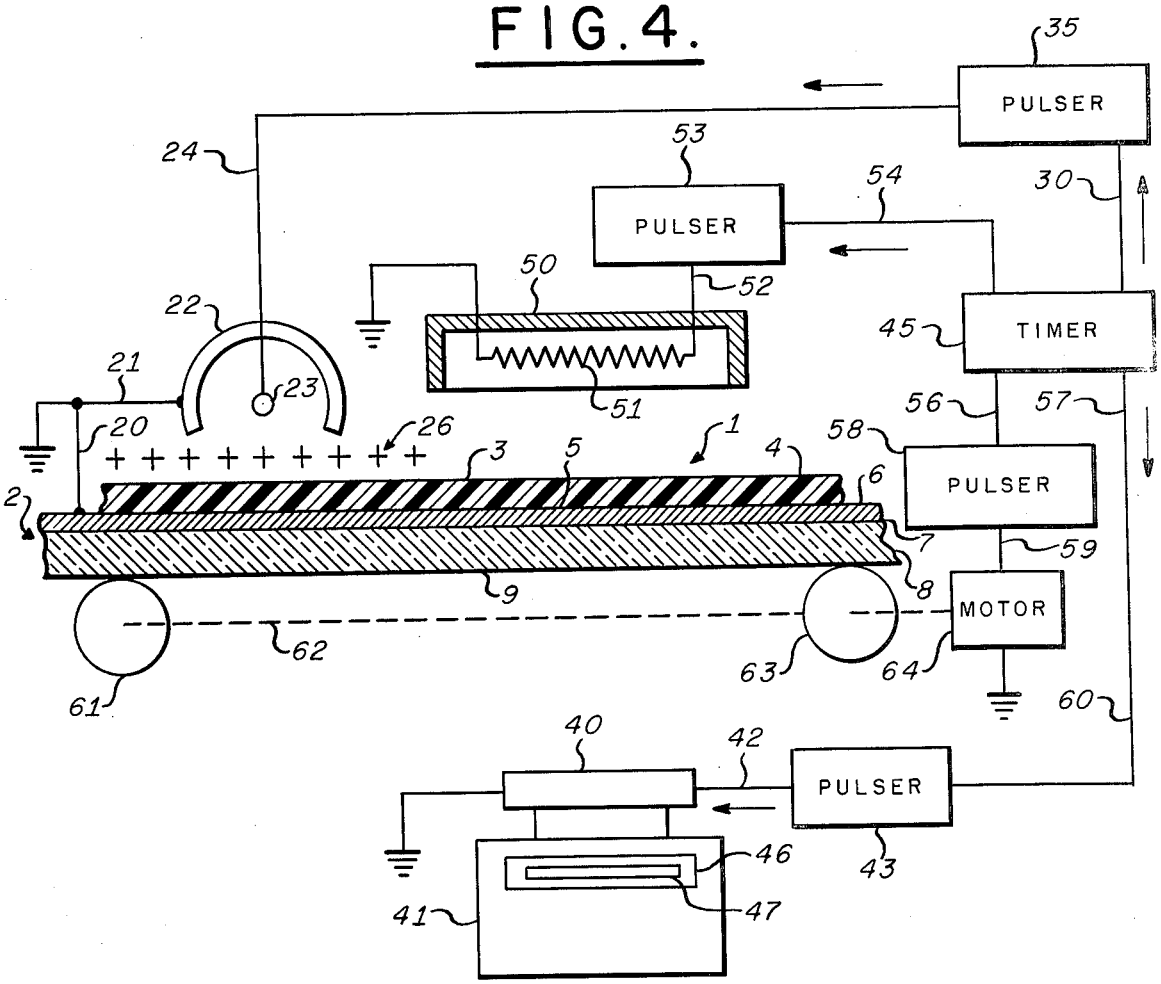

In the further embodiment of FIG. 5, a rearrangement of apparatus involved in the novel invention in the charging, exposure, and development steps is presented. Again, elements corresponding to those discussed in connection with FIG. 2 bear corresponding reference numerals. FIG. 5 illustrates apparatus in which charging of surface 3 to the desired level is performed at a first station, the charged photosensor system 1, 2 then being moved to a second station at which the exposure and development steps occur before the web 1, 2 and its developed image are finally translated toward other conventional utilization stations, for example, read-out and erasure stations such as are normally used for data storage purposes. In this embodiment, the photosensitive system 1, 2 may be in the form of a flexible endless motor-driven belt so that it is used again and again in many cycles of data recordation. For generating reproductions, the photosensor system 1, 2 may be injected into the charging station as a continuous web which, after charging, exposure, and development, may be automatically cut into individual sheets in the manner often achieved in conventional reproduction systems. In either event, FIG. 5 may be considered to illustrate apparatus in which a continuous photosensor web 1, 2 is passed through at least the three primary stations of the present invention.

In addition to control of the programming of the charging, exposure, and development functions, the timer 45 is adapted in FIG. 5 to control translation of the photosensitive web system 1, 2 through the stations of the apparatus. Timer 45 supplies a control signal via lead 56 to control the conventional pulser or power source 58, whose output is applied by lead 59 to motor 64. The rotor of motor 64 drives shaft 62 and thereby cooperatively rotates the journaled cylindrical drums 61 and 63 designed to support surface 9 and to translate the photosensitive web 1, 2 from left to right in the drawing during the term of any applied pulse. Additional drums may be similarly driven for cooperation with an endless belt photosensitive web 1, 2. As in FIG. 3, motor 64 may be driven before interval A–B to place a particular part of the web 1, 2 at the charging station. At a predetermined time in interval B–C, the same particular part of the web 1, 2, now charged, is placed in the combined exposure-development location. After interval C–F, motor 64 drives the web 1, 2 into utilization apparatus and again stops. This operation may be practiced manually or through the use of well known positional control systems and, being well understood in the art, does not require detailed description here.

In FIG. 5, apparatus is provided for performing additional functions similar to those accomplished in FIG. 4. A corona device at the first station of the apparatus and including sheath 22 and a wire electrode 23 is supplied with voltage pulses generated in pulser 35 upon its actuation by timer 45, the excitation of the corona device occupying the charging interval A–B seen in FIG. 3. Timer 45 is again additionally adapted to control the operation of an optical illumination system 41 located at the second station of the apparatus. For this purpose, timer 45 supplies a control signal via lead 60 to the voltage pulser 43. The output of pulser 43 is applied through lead 42 to open the normally closed optical shutter 40. Opening of shutter 40 permits white light from light source 41 to pass through a transparent image 47 placed in the projector slot 46. In this manner, the uniform charge pattern 26, which has now been placed in the field of view of the light projector 41, is altered in direct correspondence with the image on transparency 47, a latent charge image thus being formed on surface 3 during the interval C–F. Directly opposed to the projector 41 at the second station of the apparatus is a heat source including a shield 50 and a quickly responsive heat radiating element 51. Heater 51 is arranged to radiate the latent charge image below it on surface 3 for the brief interval D–F for development of a frost pattern directly corresponding to the latent charge image and, therefore, directly corresponding to the image on transparency 47. Actuation of heat radiator 51 is controlled by the output of pulser 53 appearing on lead 52, pulser 53 also being controlled in its operation by a timing signal supplied via lead 54 from the conventional timer 45.

In operation, it is seen that the corona discharge device 22, 23 places a uniform charge on a portion of the surface 3 of the photosensitive system 1, 2 in the interval A–B. The charge pattern 26 is next moved to a position between light projector 41 and heater 51. It is exposed to an optical image in the interval C–F and is simultaneously exposed during the included interval D–E to heat generated by heater 51 for formation of the frost pattern. After time F, the web system 1, 2 is translated toward utilization equipment (not shown). As previously noted, this embodiment of the invention may include well known apparatus at a utilization station for read-out and erasure of the frost image, so that the photosensitive web 1, 2 may then be returned for additional cycles of use to the input of the charging station. It will further be understood by those skilled in the art that the described embodiments of the invention are respective of many forms of the invention which may simply adapt known timing, charging, exposure, and heating elements readily available in the prior art.

An example of one set of conditions may be presented as representative. The surface 3 is charged to a potential just below the frost threshold level which is, for example, about 75 volts for a 3 micron thickness of the thermoplastic layer 4. The layer 4 is then exposed to white light at an energy density of about 10 micro-Joules per square centimeter. The heat pulse applied to substrate layer 6 in FIG. 4 during image exposure is about one Joule per square centimeter. The necessary charge density on surface 3 is achieved by applying only about a 5 kilovolt pulse to the corotron electrode 23. Useful exposure times range from 0.5 to 1.0 seconds at a radiant power of 100 milliwatts. In the example being discussed, the optimum development heat pulse duration is 60 milliseconds for a 3 micron thick thermoplastic layer.

Figure 6:
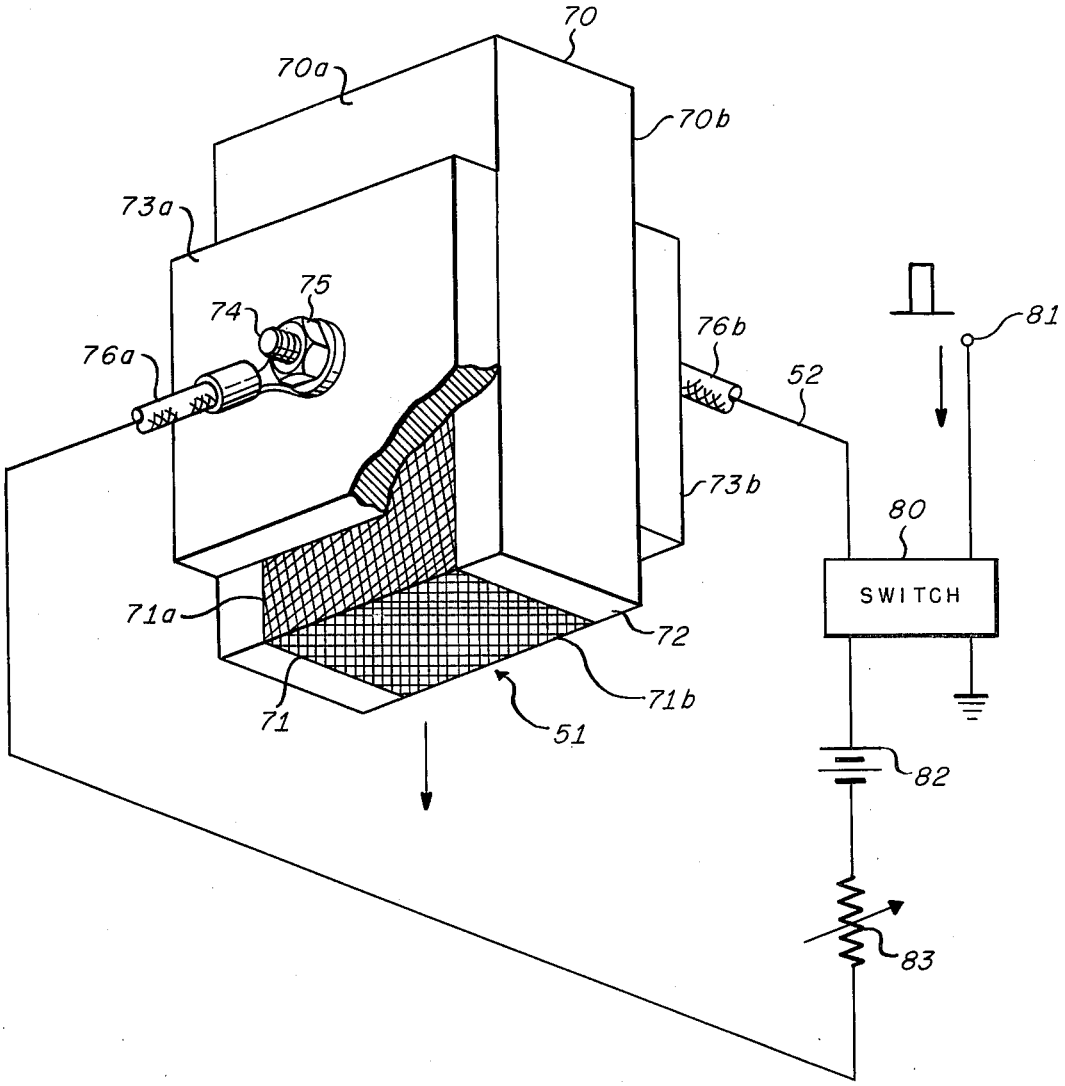
FIG. 6 is a view of the preferred form of the heater used in the apparatus of FIG. 5.

FIG. 6 illustrates a preferred form of the heater element 51 of FIG. 5; in FIG. 6, the heater element 51 is supported within the apparatus in a conventional mechanical manner from the ceramic block 70 which may be composed of a conventional electrically and thermally insulating material. The exposed face 71 of the heater element 51 faces the thermoplastic medium. Face 71 lies at the face 72 of block 70 and the heater element has extensions **71*a*, 71*b* which are generally contiguous with the opposed faces 70*a*, 70*b* of block 70. Element 51, including the extensions 71*a*, 71*b*, may be formed, for example, of a 280 mesh stainless steel screen with its wires running oblique to the edges of block 70 and the edges of face 71. opposed electrodes 73*a*, 73*b* at the respective faces 70*a*, 70*b* serve to hold heater element 51 in place and also serve as electrical contacts. For example, a conductive bolt 74 may pass through block 70 (not contacting electrode 73*b*) for clamping copper electrode 73*a* and extension 71*a* against face 70*a*; it also supplies the necessary electrical contact to lead wire 76*a* via terminal nut 75. The opposite wire 76*b* may be similarly coupled to copper electrode 73*b* and clamps extension 71*b* of heater element 51** in place.

In one form of the invention in which the active heat radiating face 71 was 1.5 square centimeters, a low-voltage, high-current pulse was applied to lead wires **76*a*, 76*b* by operation of a conventional semiconductor switch 80 by a pulsed wave form supplied to terminal 81 of the switch. The high-current pulse was supplied from a battery 82 through a variable resistor 83 in series with switch 80. Depending upon the proximity of the thermoplastic medium, the pulse applied to heater 51** was selected to lie between 6 and 10 volts with a current amplitude from about 50 to about 100 amperes.

Accordingly, it is seen that the invention provides novel apparatus and methods whereby improved thermoplastic recording or storage is performed through the generation of frost patterns on a surface of a transparent insulative thermoplastic medium. The invention overcomes the difficulties inherent in prior art frost pattern recording apparatus and methods, particularly by operation at significantly lower charging potentials whereby recorded images are produced by simple and inexpensive apparatus, images that are direct replicas of the objects or data images to be stored. The recorded image is such that bright areas of the object actually appear light in the developed image, and vice versa, with the gradations between light and dark areas substantially matching those of the object; a true "positive" image that substantially replicates the object is recorded or stored.

While retaining the advantages of prior art frost reproduction systems, the invention also forms the frost image in essentially a single-layer thermoplastic medium of simple nature, the low charging voltage greatly reducing the probability of damage to and aging of the thermoplastic medium during multiple charging cycles. Recording medium fatigue is correspondingly diminished, as essential condition in optical storage systems.

While the invention has been described in its preferred embodiments, it is to be understood that the words which have been used are words of description rather than of limitation and that changes within the purview of the appended claims may be made without departing from the true scope and spirit of the invention in its broader aspects.

I claim:

1. In a method of recording at a first surface of a single layer of a thermoplastic medium composed of an optically transparent organic resin in the form of a thermoplastic polystyrene having a resistivity at its softening point between substantially $10^{12}$ and substantially $10^{18}$ ohm-centimeters and having dispersed therein particles of photosensitive copper phthalocyanine dye responsive to visible radiation, the steps of:

substantially uniformly and directly charging at least a portion of said first surface to a predetermined charge density in a first predetermined period of time substantially lower than the normal thereshold charge density required to produce a frost pattern at said surface in the absence of exposure to visible radiation but in the presence of subsequent exposure to heat, directly exposing said portion, through a second surface opposite said first surface, after said first predetermined period of time, to visible radiation in the form of an image pattern for a second predetermined period of time, and directly subjecting said portion during a third predetermined period of time falling within said second predetermined period of time to thermal radiation from planar radiant heater means disposed in spaced substantially parallel relation with respect to said surface, whereby a frost image is generated upon said portion that is an image substantially replicating said image pattern, said third predetermined period of time falling mainly in the later part of said second predetermined period of time and said second predetermined period of time extending to a time later than the end of said third predetermined period of time.

* * * * *